US008934799B2

(12) United States Patent
Watanabe

(10) Patent No.: US 8,934,799 B2
(45) Date of Patent: Jan. 13, 2015

(54) IMAGE FORMING APPARATUS THAT COLLECTS TONER THAT IS NOT USED IN IMAGE DEVELOPMENT

(71) Applicant: Kyocera Document Solutions Inc., Osaka (JP)

(72) Inventor: Akihiro Watanabe, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 35 days.

(21) Appl. No.: 13/759,234

(22) Filed: Feb. 5, 2013

(65) Prior Publication Data

US 2013/0216251 A1 Aug. 22, 2013

(30) Foreign Application Priority Data

Feb. 20, 2012 (JP) ..... 2012-033680

(51) Int. Cl.

| | |
|---|---|
| ***G03G 15/06*** | (2006.01) |
| ***G03G 21/00*** | (2006.01) |
| ***G03G 15/09*** | (2006.01) |
| ***G03G 15/08*** | (2006.01) |
| ***G03G 21/10*** | (2006.01) |

(52) U.S. Cl.

CPC ..... *G03G 21/105* (2013.01); *G03G 15/0812* (2013.01); *G03G 15/0815* (2013.01); *G03G 15/0942* (2013.01)

USPC ..... 399/55; 399/99; 399/272; 399/273; 399/282

(58) Field of Classification Search

USPC ..... 399/270, 272, 273, 282, 55, 99

See application file for complete search history.

(56) References Cited

U.S. PATENT DOCUMENTS

| | | | | |
|---|---|---|---|---|
| 7,599,612 | B2 * | 10/2009 | Moseley et al. | 388/811 |
| 7,995,960 | B2 * | 8/2011 | Kamimura | 399/357 |
| 2002/0018672 | A1 | 2/2002 | Ozawa et al. | |
| 2007/0272374 | A1 | 11/2007 | Moseley et al. | |
| 2009/0003891 | A1 | 1/2009 | Fujishima et al. | |
| 2009/0169258 | A1 | 7/2009 | Kamimura et al. | |
| 2010/0111552 | A1 * | 5/2010 | Shiraki et al. | 399/55 |

FOREIGN PATENT DOCUMENTS

| | | | |
|---|---|---|---|
| JP | 2002-351220 | A | 12/2002 |
| JP | 2005-099344 | A | 4/2005 |
| JP | 2009-31749 | A | 2/2009 |
| JP | 2009-258276 | | 11/2009 |
| JP | 2010-145595 | A | 7/2010 |
| JP | 2011-013248 | A | 1/2011 |

* cited by examiner

*Primary Examiner* — Sandra Brase

(74) *Attorney, Agent, or Firm* — Morgan, Lewis & Bockius LLP

(57) ABSTRACT

An image forming apparatus has a first voltage application section for applying a first bias to a magnetic roller, a second voltage application section for applying a second bias to a developing roller, and a controller for controlling the voltages of the first and second voltage application sections and the driving/rotating of the magnetic roller and the developing roller. When no image formation is taking place, the controller can execute a toner collection mode in which, with the first and second biases set at the same potential and the second bias set lower than the voltage applied to an image carrying member, the magnetic roller is rotated in the direction reverse to that in which it is rotated during image formation.

10 Claims, 2 Drawing Sheets

IMAGE FORMING APPARATUS THAT COLLECTS TONER THAT IS NOT USED IN IMAGE DEVELOPMENT

INCORPORATION BY REFERENCE

This application is based on and claims the benefit of priority from Japanese Patent Application No. 2012-033680 filed on Feb. 20, 2012, the contents of which are hereby incorporated by reference.

BACKGROUND

The present disclosure relates to image forming apparatuses such as copiers, printers, facsimile machines, and multifunction products having any of those integrated together. More particularly, the present disclosure relates to image forming apparatuses that use developer containing toner and magnetic carrier and that develop an electrostatic latent image on a photosensitive drum by making a developing roller carry toner alone.

As developing devices for developing an electrostatic latent image on a photosensitive drum as an image carrying member, there are known those adopting a single-component development method and those adopting a two-component development method. A two-component development method, for its use of developer containing toner and magnetic carrier, ensures a stable amount of electric charge for a long period and is thus suitable for aiming at a longer lifetime. For example, a developing device adopting a two-component development method accommodates developer containing toner and magnetic carrier, and feeds the developer from a stirring member to a developing roller. The developing roller includes a magnet inside it, and by the action of the magnet it carries the developer in the form of a magnetic brush on the surface of the developing roller. The developing roller, by rotating, transports the developer toward a photosensitive drum. The developing device further includes a restricting member for restricting the layer thickness of the developer with a view to making constant the amount of developer transported to the photosensitive drum by the rotation of the developing roller. Where the developing roller is located just opposite the photosensitive drum, only the toner contained in the developer carried on the developing roller is fed to the photosensitive drum, and an electrostatic latent image on the photosensitive drum is developed into a visible image in the form of a toner image.

When the restricting member restricts the layer thickness of the developer and forms a uniform layer of the developer on the surface of the developing roller, the toner in the developer is rubbed by the restricting member and scatters like a smoke of dust around the restricting member. The scattered toner attaches to and gradually deposits on the downstream-side surface of the restricting member with respect to the rotation direction of the developing roller. When the deposit of toner comes off the restricting member, is carried on the developing roller, and attaches to the photosensitive drum, it ends in being transferred onto a recording medium, producing a degraded image.

To prevent that, an image forming apparatus is so configured that, for the purpose of scraping off the deposit of toner attached to the restricting member, the rotation of the photosensitive drum is stopped with the developing bias between the photosensitive drum and the developing roller turned off, and moreover the developing roller is rotated in the direction reverse to that in which it is rotated during image formation.

There are various two-component development methods other than the one described above. For example, in one development method, toner alone is carried on the developing roller to develop an electrostatic latent image on the photosensitive drum. An image forming apparatus adopting this method includes a magnetic roller, a developing roller, and a restricting member. The magnetic roller, by action of a magnet included in it, carries developer containing toner and magnetic carrier in the form of a magnetic brush on its surface, and, by rotating, transports the carried magnetic brush. The developing roller is arranged opposite the image carrying member and opposite the magnetic roller, and carries on its surface the toner contained in the magnetic brush transported by the magnetic roller and feeds the carried toner to a photosensitive drum. The restricting member is arranged at a predetermined interval from the magnetic roller, and restricts the layer thickness of the developer on the surface of the magnetic roller. In this image forming apparatus, when toner is fed from the developing roller to the photosensitive drum to develop an electrostatic latent image on the photosensitive drum, the toner fed from the developing roller may, instead of being used in the development of the electrostatic latent image, scatter around the developing roller. The scattered toner falls onto the restricting member arranged opposite the magnetic roller. As image formation is repeated, the fallen toner deposits on the restricting member. During image formation, the deposited toner moves via the magnetic roller to the developing roller, and then attaches to the photosensitive drum. This, inconveniently, results in a degraded image on a recording medium.

The present disclosure is directed to an image forming apparatus that develops an electrostatic latent image on an image carrying member by making a developing roller carry toner alone, and aims to provide an image forming apparatus that collects toner that, instead of being fed to the image carrying member, has scattered around the developing roller.

SUMMARY

According to one aspect of the present disclosure, an image forming apparatus is provided with: an image carrying member, a magnetic roller, a developing roller, a restricting member, a first voltage application section, a second voltage application section, and a controller. On the surface of the image carrying member, an electrostatic latent image is formed. The magnetic roller, by action of a magnet included in it, carries two-component developer containing toner and magnetic carrier in the form of a magnetic brush, and, by rotating, transports the carried magnetic brush. The developing roller is arranged opposite the image carrying member and opposite the magnetic roller, and carries on its surface the toner contained in the magnetic brush transported by rotation of the magnetic roller and feeds the carried toner to the image carrying member. The restricting member is arranged under the developing roller at a predetermined interval from the magnetic roller, and restricts the layer thickness of the developer on the surface of the magnetic roller. The first voltage application section applies a first bias to the magnetic roller. The second voltage application section applies a second bias to the magnetic roller. The controller can execute, when no image formation is taking place, a toner collection mode in which, with the first and second biases set at the same potential and the second bias set lower than the voltage applied to the image carrying member, the magnetic roller is rotated in the direction reverse to the direction in which the magnetic roller is rotated during image formation.

This and other objects of the present disclosure, and the specific benefits obtained according to the present disclosure, will become apparent from the description of embodiments which follows.

DETAILED DESCRIPTION

Hereinafter, an embodiment of the present disclosure will be described with reference to the accompanying drawings. The present disclosure, however, is in no way limited by the embodiment, nor are the applications of the disclosure and the terms etc. used therein limited to those specifically mentioned herein.

Figure 1:
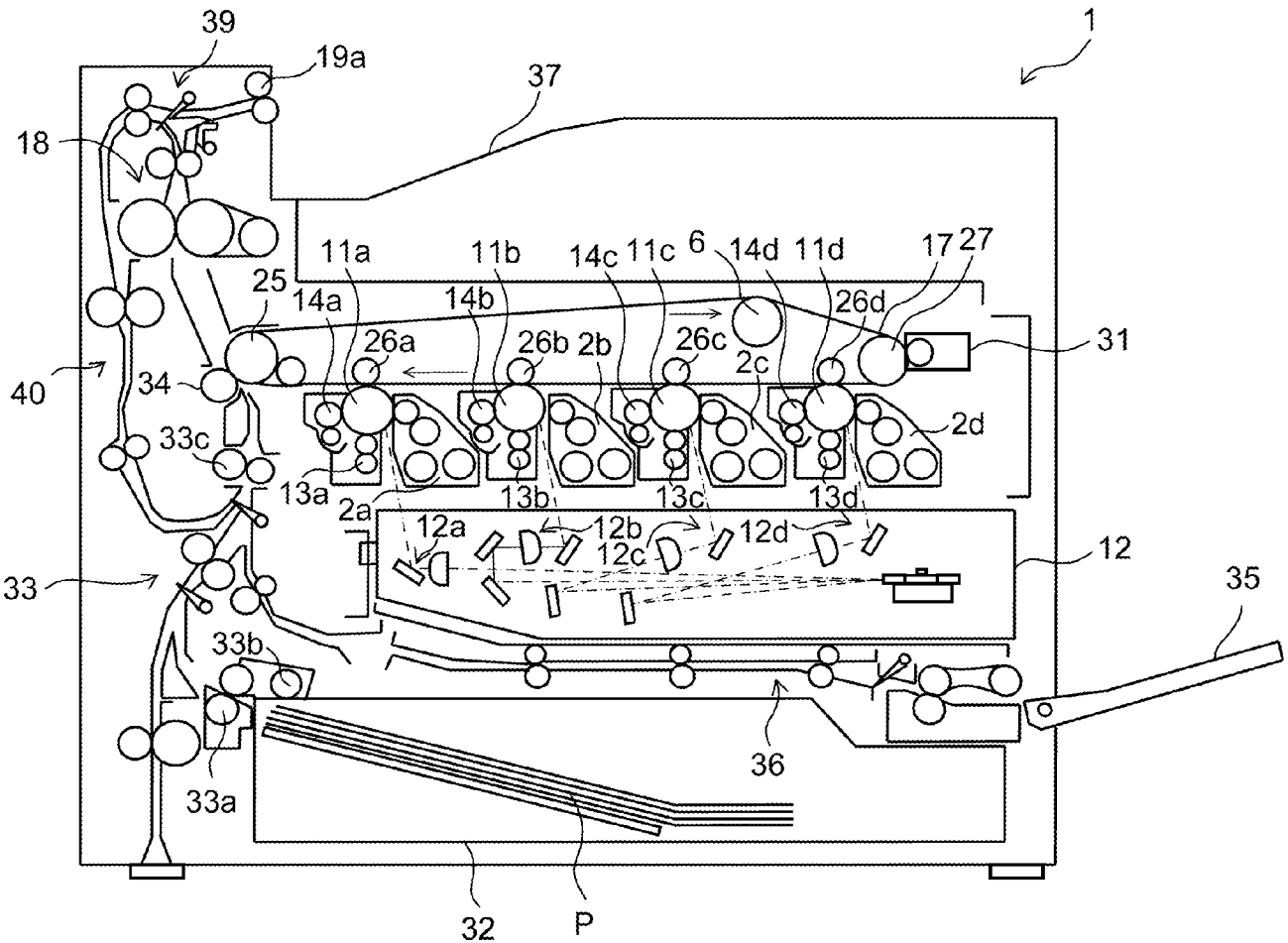
FIG. 1 is a diagram schematically showing an image forming apparatus according to an embodiment of the present disclosure.

FIG. 1 is a diagram schematically showing the construction of an image forming apparatus provided with a developing device according to one embodiment of the present disclosure. The image forming apparatus 1 is a tandem-type color printer. Rotatable photosensitive drums 11*a* to 11*d* comprise an organic photosensitive substance (OPC photosensitive substance) as a photosensitive material for forming a photosensitive layer, and are arranged so as to correspond to different colors, namely magenta, cyan, yellow, and black respectively. Around the photosensitive drums 11*a* to 11*d*, there are arranged developing devices 2*a* to 2*d*, an exposure unit 12, chargers 13*a* to 13*d*, and cleaning devices 14*a* to 14*d*.

The developing devices 2*a* to 2*d* are arranged opposite, on the right of, the photosensitive drums 11*a* to 11*d* respectively, and feed toner to the photosensitive drums 11*a* to 11*d*. The chargers 13*a* to 13*d* are arranged on the upstream side of the developing devices 2*a* to 2*d* with respect to the rotation direction of the photosensitive drums 11*a* to 11*d*, so as to be opposite the surfaces of the photosensitive drums 11*a* to 11*d*, and electrically charge the surfaces of the photosensitive drums 11*a* to 11*d* uniformly.

The exposure unit 12 is for scan-exposing the photosensitive drums 11*a* to 11*d* based on image data, such as characters and graphics, fed from a personal computer or the like to an image input section (not illustrated), and is arranged under the developing devices 2*a* to 2*d*. The exposure unit 12 includes a laser light source and a polygon mirror, and further includes, corresponding to the photosensitive drums 11*a* to 11*d* respectively, optical systems 12*a* to 12*d* each comprising a reflective mirror, a lens, etc. The laser light emitted from the laser light source is shone, via the polygon mirror, the reflective mirror, and the lens, onto the surfaces of the photosensitive drums 11*a* to 11*d* from the downstream side of the chargers 13*a* to 13*d* with respect to the photosensitive drum rotation direction. The laser light thus shone forms electrostatic latent images on the surfaces of the photosensitive drums 11*a* to 11*d*, and these electrostatic latent images are developed into toner images by the developing devices 2*a* to 2*d* respectively.

An endless intermediary transfer belt 17 is wound around a tension roller 6, a driving roller 25, and a driven roller 27. The driving roller 25 is driven to rotate by an unillustrated motor, and the intermediary transfer belt 17 is driven to circulate by the rotation of the driving roller 25.

In contact with the intermediary transfer belt 17, the photosensitive drums 11*a* to 11*d* are arranged next to one another along the sheet transport direction (indicated by arrows in FIG. 1) under the intermediary transfer belt 17. Primary transfer rollers 26*a* to 26*d* are arranged opposite the photosensitive drums 11*a* to 11*d* across the intermediary transfer belt 17, and are kept in pressed contact with the intermediary transfer belt 17 to form a primary transfer portion. In the primary transfer portion, as the intermediary transfer belt 17 rotates, toner images on the photosensitive drums 11*a* to 11*d* are transferred onto the intermediary transfer belt 17 sequentially with predetermined timing. As a result, on the surface of the intermediary transfer belt 17, a toner image is formed which has toner images of four colors, namely magenta, cyan, yellow, and black, are superimposed on one another.

A secondary transfer roller 34 is arranged opposite the driving roller 25 across the intermediary transfer belt 17, and is kept in pressed contact with the intermediary transfer belt 17 to form a secondary transfer portion. In the secondary transfer portion, the toner image on the surface of the intermediary transfer belt 17 is transferred onto a sheet P of a printing medium. After the transfer, a belt cleaning device 31 cleans the intermediary transfer belt 17 to remove the toner remaining on it.

In a lower part inside the image forming apparatus 1, there is arranged a sheet feed cassette 32 for accommodating sheets P, and on the right of the sheet feed cassette 32, there is arranged a stack tray 35 for manual feeding of sheets. On the left of the sheet feed cassette 32, there is arranged a first sheet transport passage 33 for transporting a sheet P fed out of the sheet feed cassette 32 to the secondary transfer portion of the intermediary transfer belt 17. On the left of the stack tray 35, there is arranged a second sheet transport passage 36 for transporting a sheet fed out of the stack tray 35 to the secondary transfer portion. Moreover, in an upper left part inside the image forming apparatus 1, there are arranged a fixing section 18 which performs a fixing process on a sheet P having a toner image formed on it, and a third sheet transport passage 39 for transporting a sheet P having undergone the fixing process to a sheet ejection section 37.

The sheet feed cassette 32, when drawn out of the apparatus (forward from the plane of FIG. 1), can be replenished with sheets P. The sheets P accommodated in the sheet feed cassette 32 are fed out one-by-one toward the first sheet transport passage 33 by a pick-up roller 33*b* and handling rollers 33*a*.

The first sheet transport passage 33 and the second sheet transport passage 36 meet just before reaching a pair of resist rollers 33*c*. The pair of resist rollers 33*c*, while coordinating timing between the image forming operation on the intermediary transfer belt 17 and the feeding of a sheet P, feeds the sheet P to the secondary transfer portion. Onto the sheet P transported to the secondary transfer portion, the secondary transfer roller 34 having a transfer bias applied to it secondarily transfers the toner image off the intermediary transfer belt 17. Then the sheet P is transported to the fixing section 18.

The fixing section 18 includes a fixing belt which is heated by a heater or the like, a fixing roller which is kept in contact with the fixing belt from inside, a pressing roller which is arranged in pressed contact with the fixing roller across the fixing belt, etc. The fixing section 18 performs a fixing process by heating and pressing the sheet P having the toner image formed on it. The sheet P, after having the toner image fixed on it in the fixing section 18, is as necessary reversed in a fourth sheet transport passage 40, in which case the sheet P then has a toner image secondarily transferred onto its reverse side as well by the secondary transfer roller 34 and is then subjected to the fixing process in the fixing section 18. The sheet having the toner image fixed on it is transported through the third sheet transport passage 39 so as to be ejected onto the sheet ejection section 37 by a pair of ejection rollers 19*a*.

Figure 2:
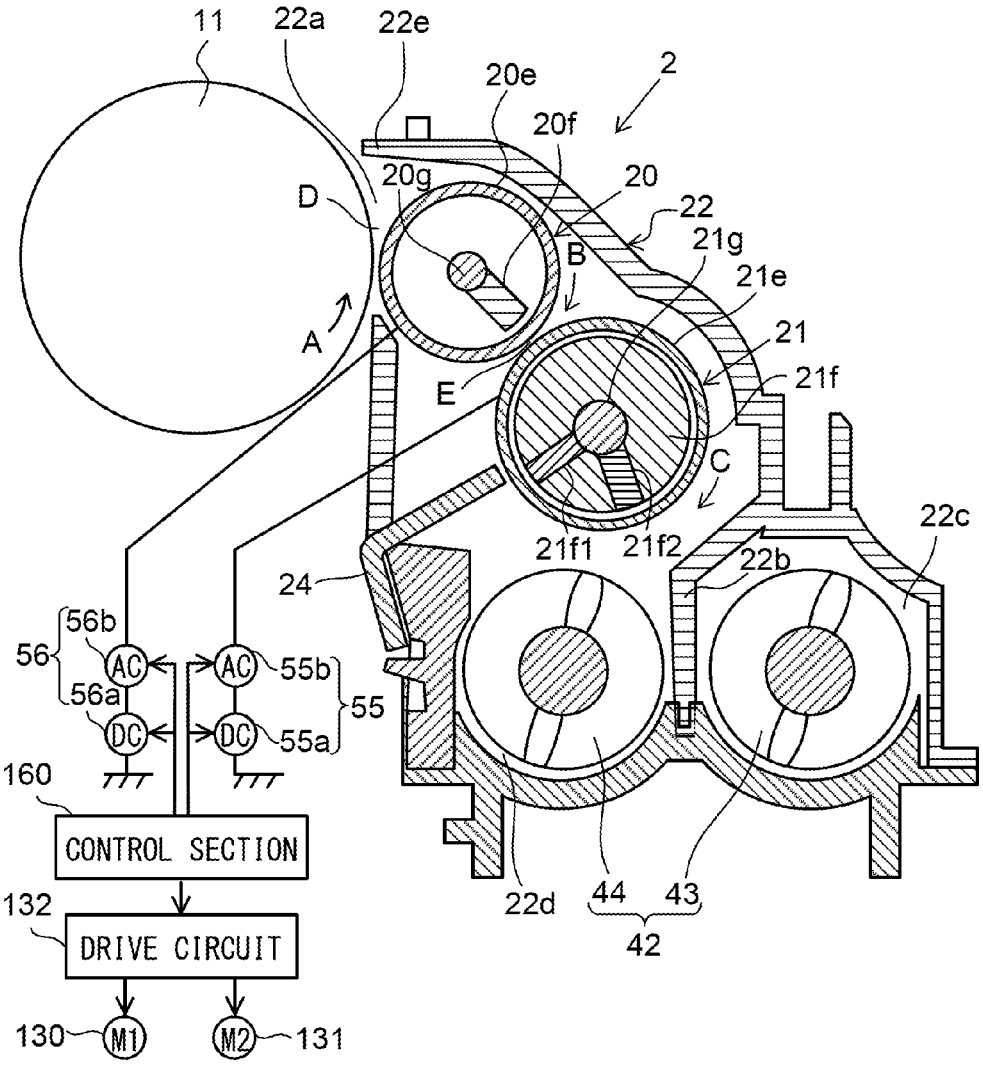
FIG. 2 is a sectional view schematically showing a developing device provided in an image forming apparatus according to an embodiment of the present disclosure.

FIG. 2 is a sectional view showing the construction of the developing device used in the image forming apparatus 1 described above. Although the following description deals with the construction and operation of the developing device 2*a* corresponding to the photosensitive drum 11*a* shown in FIG. 1, it should be understood that the construction and operation of the developing devices 2*b* to 2*d* are similar to those of the developing device 2*a*, and that the suffixes "a" to "d" in the reference signs representing the developing devices and photosensitive drums for different colors are omitted unless necessary.

The developing device 2 is composed of a developing roller 20, a magnetic roller 21, a stirring section 42, a restricting member 24, a developer container 22, etc.

The developer container 22 forms the housing of the developing device 2, and a lower part of the developer container 22 is divided by a partitioning member 22*b* into a first transport passage 22*d* and a second transport passage 22*c*. The first and second transport passages 22*d* and 22*c* accommodate two-component developer containing toner and magnetic carrier. Moreover, the developer container 22 rotatably holds a first stirring member 44 and a second stirring member 43 in the stirring section 42 and also the magnetic roller 21 and the developing roller 20. In an upper part 22*e* of the developer container 22, an opening 22*a* is formed through which the developing roller 20 is exposed toward the photosensitive drum 11 as an image carrying member.

The stirring section 42 is provided in a bottom part of the developer container 22, and is composed of the first stirring member 44 and the second stirring member 43. The first stirring member 44 is provided inside the first transport passage 22*d*, and the second stirring member 43 is provided, on the right of the first stirring member 44 next to it, inside the second transport passage 22*c*.

The first and second stirring members 44 and 43 stir the developer and thereby electrically charge the toner contained in the developer to a predetermined level. This permits the toner to be held by the magnetic carrier. At opposite ends, in the longitudinal direction (the direction penetrating the plane of FIG. 2), of the partitioning member 22*b* separating the first and second transport passages 22*d* and 22*c*, communicating portions (not illustrated) are provided. Thus, as the second stirring member 43 rotates, the charged developer is transported through one of the communicating portions formed in the partitioning member 22*b* into the first transport passage 22*d* so as to circulate inside the first and second transport passages 22*d* and 22*c*. From the first stirring member 44, the developer is fed to the magnetic roller 21.

The magnetic roller 21 is arranged over the first stirring member 44 so as to be opposite it. The magnetic roller 21 carries and transports the developer fed from the first stirring member 44, and feeds the toner alone to the developing roller 20. Opposite the circumferential surface of the magnetic roller 21, the restricting member 24 is arranged.

The restricting member 24 is formed in the shape of a plate out of a magnetic material such as stainless steel, and is fixed to and held on the developer container 22 on the lower left of the magnetic roller 21, under the developing roller 20. The tip part of the restricting member 24 is located opposite the surface of the magnetic roller 21 at a predetermined interval from it, and restricts the layer thickness of the developer carried on the surface of the magnetic roller 21.

The magnetic roller 21 includes a rotary sleeve 21*e* formed of a non-magnetic material, a magnetic pole member 21*f*, and a roller shaft 21*g*.

The magnetic pole member 21*f* comprises a plurality of magnets having different polarities in peripheral parts. The magnetic pole member 21*f* has a restricting pole 21*f*1, which is an N pole, at a position opposite the restricting member 24, and has a collecting pole 21*f*2 where magnetic poles of the same polarity are arranged next to one another in the circumferential direction. The collecting pole 21*f*2 has a weaker magnetic force than other magnetic poles of the magnetic pole member 21*f*, and does not allow the developer to be carried on the surface of the magnetic roller 21 but permits the developer that has remained unused in development to be collected back in the stirring section 42. The magnetic pole member 21*f* is fixed to the roller shaft 21*g* as by being bonded to it, and the roller shaft 21*g* is unrotatably supported on the developer container 22.

The rotary sleeve 21*e* is arranged at a predetermined interval from the magnetic pole member 21*f* so that, on the surface of the rotary sleeve 21*e*, the developer is carried as a magnetic brush. The rotary sleeve 21*e* is rotatably supported on the developer container 22, and, by being rotated in the direction indicated by arrow C by a driving mechanism comprising a developing motor 131 and unillustrated gears, transports the magnetic brush. Moreover, to the rotary sleeve 21*e*, a first voltage application section 55 applies a first bias which is a voltage having an alternating-current voltage 55*b* superimposed on a direct-current voltage 55*a*.

The developing roller 20 is located opposite the magnetic roller 21, obliquely on its upper left, and is composed of a developing sleeve 20*e*, a magnetic pole member 20*f*, a fixed shaft 20*g*, etc.

The developing sleeve 20*e* is formed in a cylindrical shape out of a non-magnetic material, and is rotatably supported on the developer container 22. The magnetic pole member 20*f* is arranged in a position E opposite the magnetic roller 21 at a predetermined interval from the developing sleeve 20*e*, and is fixed to the fixed shaft 20*g* as by being bonded to it. The fixed shaft 20*g* is unrotatably supported on the developer container 22. The developing sleeve 20*e* is located opposite the photosensitive drum 11, on its right and at a predetermined interval from it, and forms a development region D where toner is fed to the photosensitive drum 11. The developing sleeve 20*e* is rotated in the direction indicated by arrow B, that is, in the same direction as the rotary sleeve 21*e*, by the driving mechanism comprising the developing motor 131 and unillustrated gears. To the developing sleeve 20*e*, a second voltage application section 56 applies a second bias which is a voltage having an alternating-current voltage 56*b* superimposed on a direct-current voltage 56*a*.

Thus, on the surface of the rotary sleeve 21*e* of the magnetic roller 21, the charged developer is carried in the form of the magnetic brush formed by the magnetic force of the magnetic pole member 21*f*, and as the rotary sleeve 21*e* is rotated in the direction indicated by arrow C by the developing motor 131, the magnetic brush is transported. The magnetic brush is adjusted by the restricting member 24 and the restricting pole 21*f*1 to have a predetermined thickness. The magnetic brush now having the predetermined thickness is further transported by the rotary sleeve 21*e* to the opposing position E. At the opposing position E, the magnetic brush is raised by the magnetic pole member 20*f* of the developing roller 20 and makes contact with the developing sleeve 20*e*. Here, applying the first bias from the first voltage application section 55 and the second bias from the second voltage application section 56 with a potential difference between them causes only the toner of the magnetic brush to be fed from the rotary sleeve 21*e* to the developing sleeve 20*e*. The part of the magnetic brush that has remained unfed to the developing sleeve 20*e* is, as the rotary sleeve 21*e* rotates in the direction indicated by arrow C, transported over to the collecting pole 21*f*2, where the remaining magnetic brush ceases to be carried on the rotary sleeve 21*e* and returns to the first stirring member 44.

As the developing sleeve 20*e* is rotated in the direction indicated by arrow B by the developing motor 131, the toner carried on the developing sleeve 20*e* is transported to the development region D. Here, setting the second bias from the second voltage application section 56 to be higher than the bias applied to the photosensitive drum 11, and hence the resulting potential difference between the potential of the second bias and the potential of the exposed part of the photosensitive drum 11, causes the toner carried on the developing sleeve 20*e* to fly to the photosensitive drum 11. As the photosensitive drum 11 is rotated in the direction indicated by arrow A by a drum motor 130, the flying toner sequentially attaches to the exposed part on the photosensitive drum 11, and thereby develops the electrostatic latent image on the photosensitive drum 11.

As described above, in a printing mode, the magnetic roller 21 (rotary sleeve 21*e*) rotates in the direction indicated by arrow C, the developing roller 20 (developing sleeve 20*e*) rotates in the direction indicated by arrow B, the first and second voltage application sections 55 and 56 apply biases with a potential difference between them, and the second voltage application section 56 applies a bias higher than that to the photosensitive drum 11. The embodiment under discussion has, in addition to the printing mode, a toner collection mode.

In the toner collection mode, when toner is fed from the developing roller 20 to the photosensitive drum 11, the toner fed from the developing roller 20 is not used for the development of an electrostatic latent image, but instead the toner that has fallen from the developing roller 20 onto the restricting member 24 is collected in the stirring section 42. The toner collection mode is executed when no image formation is taking place, for example, every predetermined number of sheets printed, or on occasions of maintenance of the image forming apparatus 1.

Switching between and execution of printing and toner collection modes are controlled by a controller including a control section 160 and a drive circuit 132. The control section 160 is composed of a microcomputer, a memory device such as RAM and ROM, etc. According to programs and data stored in the memory device, the control section 160 switches between the modes, controls the biases from the first and second voltage application sections 55 and 56, and controls the drive circuit 132 which drives the drum motor 130 and the developing motor 131.

The drive circuit 132 comprises a bridge circuit that applies pulse voltages to the drum motor 130 and the developing motor 131, which are, for example, DC motors. The drive circuit 132 drives the drum motor 130 and the developing motor 131 to rotate individually by applying the pulse voltages to them, and switches the rotation direction of the developing motor 131 by switching a switch within the bridge circuit. The control section 160 feeds the drive circuit 132 with a forward direction signal or a reverse direction signal.

In response to the forward direction signal, the drive circuit 132 drives the drum motor 130 to rotate so as to make the photosensitive drum 11 rotate in the direction indicated by arrow A, and drives the developing motor 131 to rotate so as to make the developing roller 20 rotate in the direction indicated by arrow B and the magnetic roller 21 rotate in the direction indicated by arrow C. On the other hand, in response to the reverse direction signal, the drive circuit 132 drives the developing motor 131 to rotate so as to make the developing roller 20 rotate in the direction reverse to that indicated by arrow B and the magnetic roller 21 rotate in the direction reverse to that indicated by arrow C. The driving mechanism between the drum motor 130 and the photosensitive drum 11 includes an unillustrated one-way clutch so that, even when the drum motor 130 is driven to rotate in response to the reverse direction signal received by the drive circuit 132, the one-way clutch prevents the photosensitive drum 11 from rotating. The driving mechanism between the developing motor 131 and the developing roller 20 may include a one-way clutch. In that case, when the drive circuit 132 receives the reverse direction signal and the developing motor 131 is driven to rotate accordingly, while the magnetic roller 21 rotates in the reverse direction, the developing roller 20 is prevented from rotating by the one-way clutch. The drum motor 130 and the developing motor 131 may be implemented with, instead of DC motors, stepping motors so that their rotation can be switched between the forward and reverse directions.

As described above, in the toner collection mode, the control section 160 feeds the drive circuit 132 with the reverse direction signal and, in response to the reverse direction signal, the drum motor 130 and the developing motor 131 are rotated in the directions reverse to those in which they are rotated in the printing mode. The photosensitive drum 11 is prevented from rotating by the one-way clutch, and the magnetic roller 21 (rotary sleeve 21*e*) is rotated in the reverse direction (the direction reverse to the direction indicated by arrow C) by the developing motor 131. The first and second biases from the first and second voltage application sections 55 and 56 are set at the same potential, and the second bias from the second voltage application section 56 is set to be lower than the charging bias that the charger 13 (see FIG. 1) applies to the photosensitive drum 11.

As a result of the first and second biases from the first and second voltage application sections 55 and 56 being set at the same potential, there is no potential difference between the developing roller 20 and the magnetic roller 21, and thus the toner does not move from the magnetic roller 21 to the developing roller 20. Moreover, as a result of the second voltage application section 56 applying a voltage lower than the charging bias applied to the photosensitive drum 11, the toner does not move from the developing roller 20 to the photosensitive drum 11. In this state, when the magnetic roller 21 rotates in the reverse direction, the magnetic brush on the magnetic roller 21 scrapes off the toner that has fallen onto a nearby part of the restricting member 24 from the developing roller 20, and the scraped-off toner is collected in the stirring section 42. This prevents the toner that has fallen near the restricting member 24 from moving to the developing roller 20, and hence prevents toner from attaching to the photosensitive drum 11 from the developing roller 20. It is thus possible to obtain a satisfactory image.

In the embodiment, the drive circuit 132 is so configured that it can, by varying the width of the pulse voltage applied to the developing motor 131, vary the rotation speed of the developing motor 131. In the toner collection mode, the developing motor 131 is so controlled as to make the magnetic roller 21 rotate in the reverse direction at a lower rotation speed than in the printing mode. This permits the toner that has fallen near the restricting member 24 to be scraped off gently by the magnetic brush, and thus prevents the fallen toner from scattering around the restricting member 24.

In the embodiment, in the toner collection mode, the developing motor 131 is so controlled as to make the magnetic roller 21 rotate one turn or more in the direction reverse to that in which it rotates in the printing mode. This ensures that the toner that has fallen near the restricting member 24 is collated in the stirring section 42.

In the embodiment, in the toner collection mode, the developing motor 131 is so controlled as to make the magnetic roller 21 rotate first in the direction reverse to the direction indicated by arrow C and then in the direction indicated by arrow C. By rotating the magnetic roller 21 in the direction indicated by arrow C, it is possible to carry and transport on the magnetic roller 21 the developer fed from the stirring section 42 so that, after toner collection, image formation can be started promptly.

The present disclosure finds applications in image forming apparatuses such as copiers, printers, facsimile machines, and multifunction products having any of those integrated together, and in particular in image forming apparatuses that use developer containing toner and magnetic carrier and that develop an electrostatic latent image on a photosensitive drum by making a developing roller carry toner alone.

What is claimed is:

1. An image forming apparatus comprising:

an image carrying member on a surface of which an electrostatic latent image is formed;

a magnetic roller which, by action of a magnet included therein, carries two-component developer containing toner and magnetic carrier in a form of a magnetic brush on a surface thereof and which, by rotating, transports the carried magnetic brush;

a developing roller arranged opposite the image carrying member and opposite the magnetic roller, the developing roller carrying on a surface thereof the toner contained in the magnetic brush transported by rotation of the magnetic roller and feeding the carried toner to the image carrying member;

a restricting member arranged under the developing roller at a predetermined interval from the magnetic roller, the restricting member restricting a layer thickness of the developer on the surface of the magnetic roller;

a first voltage application section for applying a first bias to the magnetic roller;

a second voltage application section for applying a second bias to the developing roller; and a controller capable of executing, when no image formation is taking place, a toner collection mode in which, with the first and second biases set at a same potential and the second bias set lower than a voltage applied to the image carrying member, the magnetic roller is rotated in a direction reverse to a direction in which the magnetic roller is rotated during image formation, wherein in the toner collection mode, the image carrying member remains stationary.

2. The image forming apparatus according to claim 1, wherein in the toner collection mode, the controller makes the magnetic roller rotate at a lower rotation speed than, and in the direction reverse to the direction in which the magnetic roller is rotated, during image formation.

3. The image forming apparatus according to claim 2, wherein the controller includes:

a drive circuit which drives a developing motor which makes the magnetic roller and the developing roller rotate; and a control section which controls the drive circuit, the drive circuit includes a bridge circuit which can vary a width of a pulse voltage applied to the developing motor, and the developing motor comprises a DC motor.

4. The image forming apparatus according to claim 1, wherein in the toner collection mode, the controller makes the magnetic roller rotate one turn or more in the direction reverse to the direction in which the magnetic roller is rotated during image formation.

5. The image forming apparatus according to claim 1, wherein in the toner collection mode, the controller makes the magnetic roller rotate first in the direction reverse to the direction in which the magnetic roller is rotated during image formation and then in a same direction as during image formation.

6. The image forming apparatus according to claim 1, wherein the toner collection mode is executed every predetermined number of sheets printed.

7. The image forming apparatus according to claim 1, wherein the toner collection mode is executed on an occasion of maintenance of the image forming apparatus.

8. The image forming apparatus according to claim 1, wherein the controller includes:

a drive circuit which drives a developing motor which makes the magnetic roller and the developing roller rotate; and a control section which controls the drive circuit, the drive circuit includes a bridge circuit which applies a pulse voltage to the developing motor, and the developing motor comprises a DC motor.

9. An image forming apparatus comprising:

an image carrying member on a surface of which an electrostatic latent image is formed;

a magnetic roller which, by action of a magnet included therein, carries two-component developer containing toner and magnetic carrier in a form of a magnetic brush on a surface thereof and which, by rotating, transports the carried magnetic brush;

a developing roller arranged opposite the image carrying member and opposite the magnetic roller, the developing roller carrying on a surface thereof the toner contained in the magnetic brush transported by rotation of the magnetic roller and feeding the carried toner to the image carrying member;

a restricting member arranged under the developing roller at a predetermined interval from the magnetic roller, the restricting member restricting a layer thickness of the developer on the surface of the magnetic roller;

a first voltage application section for applying a first bias to the magnetic roller;

a second voltage application section for applying a second bias to the developing roller; and a controller capable of executing, when no image formation is taking place, a toner collection mode in which, with the first and second biases set at a same potential and the second bias set lower than a voltage applied to the image carrying member, the magnetic roller is rotated in a direction reverse to a direction in which the magnetic roller is rotated during image formation, wherein in the toner collection mode, the developing roller remains stationary.

10. The image forming apparatus according to claim 9, wherein the controller includes:

a drive circuit which drives a developing motor which makes the magnetic roller and the developing roller rotate; and a control section which feeds the drive circuit with a forward direction signal or a reverse direction signal, between the developing motor and the developing roller, a one-way clutch is provided which prevents the developing roller from rotating in a reverse direction, the drive circuit drives the developing motor in response to the reverse direction signal, the magnetic roller is driven by the developing motor to rotate in the direction reverse to the direction in which it rotates during image formation, and the developing roller is prevented by the one-way clutch from rotating in the reverse direction.

* * * * *